United States Patent [19]

Turns et al.

[11] 3,982,514

[45] Sept. 28, 1976

[54] METHOD AND MEANS FOR RECOVERING QUENCH LAYER COMBUSTIBLES FROM ENGINE COMBUSTION CHAMBERS

[75] Inventors: Stephen R. Turns, Warren; Robert M. Siewert, Birmingham, both of Mich.

[73] Assignee: General Motors Corporation, Detroit, Mich.

[22] Filed: Feb. 21, 1975

[21] Appl. No.: 551,542

[52] U.S. Cl. ..... 123/119 A; 123/75 C

[51] Int. Cl.[2] ..... F02M 31/00

[58] Field of Search ..... 123/119 A, 75 C

[56] References Cited

UNITED STATES PATENTS

| | | | |
|---|---|---|---|
| 2,701,556 | 2/1955 | Woerner | 123/119 A |
| 3,875,914 | 4/1975 | Villella | 123/119 A |

FOREIGN PATENTS OR APPLICATIONS

| | | | |
|---|---|---|---|
| 226,495 | 10/1910 | Germany | 123/119 A |

*Primary Examiner*—Charles J. Myhre
*Assistant Examiner*—R. H. Lazarus
*Attorney, Agent, or Firm*—Robert J. Outland

[57] ABSTRACT

Peripheral areas of the combustion chambers of an internal combustion engine are provided with perforated walls bordering external collection volumes for receiving wall quench combustibles forced through the perforations from the combustion chambers. The combustibles are recirculated to the engine induction system through passages connecting with the collection volumes, valves being provided to time the flow to take place in portions of the expansion and exhaust steps of the engine cycle which maximize the collection of quench layer combustibles while avoiding excessive cylinder pressure and efficiency losses.

6 Claims, 4 Drawing Figures

METHOD AND MEANS FOR RECOVERING QUENCH LAYER COMBUSTIBLES FROM ENGINE COMBUSTION CHAMBERS

BACKGROUND OF THE INVENTION

The present invention relates to internal combustion engines and more particularly to methods and arrangements for reducing the amount of quench layer combustibles (primarily hydrocarbons) exhausted from the combustion chambers through the exhaust system by recirculating some of these combustibles to the engine intake through their timed ejection from the combustion chambers to peripheral collection and recirculating means.

It has been generally recognized that a significant cause of hydrocarbon emissions in the exhaust gases of spark ignition internal combustion engines is the carrying out with the exhaust products of combustibles remaining along the walls of the combustion chambers after combustion has ceased. These combustibles are considered to result from flame quenching along the relatively cold walls of the combustion chambers which prevents the completion of the combustion process along the surface of the walls, leaving a layer of unburned and partially burned products, known as the wall quench layer. In the exhaust process, this layer of combustibles is partially stripped from the walls by upward movement of the engine piston, or other means, and is mixed with the exhaust gases passing into the engine exhaust system.

SUMMARY OF THE INVENTION

The present invention provides methods and means for preventing the loss to the engine exhaust system of at least some of the combustibles in the wall quench layer. This is accomplished by perforating, i.e. providing small passages through, the peripheral portions of the combustion chamber where are collected a significant portion of the wall quench combustibles, which would otherwise be exhausted.

A peripheral collection volume is provided around each combustion chamber and connected therewith through the wall perforations. The combustibles in the wall quench layer are stripped from the wall and carried into the adjacent collection volumes through the timed passage or flow of some of the combustion chamber gases through the wall perforations after the end of combustion in the combustion chamber on each engine cycle. Appropriate passages and control valves are provided for recirculating the stripped quench gases to the engine induction system and preventing their return into the combustion chamber. In this way the loss of combustibles through the engine exhaust system is reduced.

Details of the invention and various ways in which it may be carried into effect will be more fully understood from the following description of selected embodiments, taken together with the accompanying drawing.

DESCRIPTION OF THE ILLUSTRATED EMBODIMENTS

Figure 1:
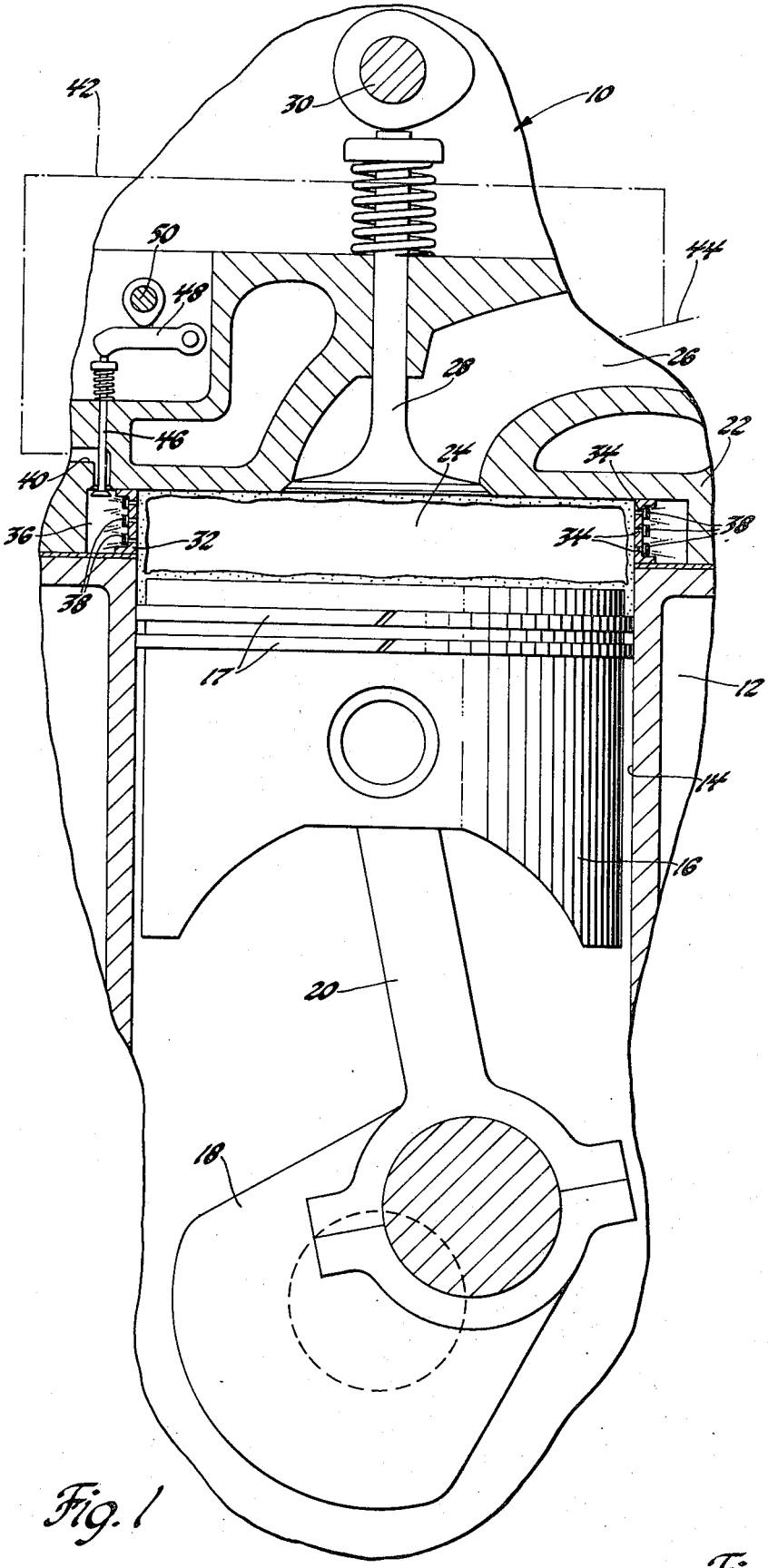
FIG. 1 is a fragmentary cross-sectional view of an internal combustion engine having quench layer recirculation means in accordance with the invention.

Referring now more specifically to the drawing, numeral 10 generally indicates an internal combustion engine formed in accordance with the invention and including the usual cylinder block 12 having a plurality of aligned cylinders 14, only one being shown. A piston 16 having rings 17 is reciprocably carried within each of the cylinders and is conventionally linked with a cylinder block mounted crankshaft 18 through a connecting rod 20. The ends of the cylinders 14 are closed by a cylinder head 22 which is mounted on the block 12. Together with the cylinder and piston, the head 22 defines a variable volume combustion chamber 24 at the closed end of each cylinder. The cylinder head is provided with conventional intake ports 26 and exhaust ports, not shown, connecting with their respective combustion chambers. The ports are controlled by inlet and exhaust valves 28 and actuating means in the form of camshaft 30, which is connected with the engine crankshaft in conventional manner for actuating the valves in timed relation with movement of the engine pistons.

Operation of this portion of the structure is conventional, the pistons and valves moving cyclically to cause the combustion chambers to perform sequential cycles including admission, compression, expansion and exhaust steps. Air-fuel mixtures supplied to the intake ports 26 through conventional carburetor means or the like, not shown, are admitted to the combustion chambers during their respective admission steps, compressed and ignited near the end of the compression steps by conventional spark ignition means, not shown. Burning of the mixtures takes place early in the expansion steps, after which the exhaust products are discharged in the exhaust steps.

In order to avoid the loss of combustibles remaining in the so-called wall quench layer along the walls of the combustion chamber after combustion, the engine is provided with quench layer recovery and recirculation means according to the invention. In the embodiment of FIG. 1, these means comprise a perforated annular wall 32 which extends upwardly from the walls of cylinder 14 into the combustion chamber recess of the cylinder head so as to define the outer periphery of the combustion chamber 24. Wall 32 is provided with a plurality of perforations 34 extending therethrough and connecting the combustion chamber 24 with an annular collection volume 36 surrounding the exterior of the wall 32.

Volume 36 is made as small as possible and, in any case, substantially smaller than the clearance volume of the combustion chamber 24 when the piston is at top dead center, so that is has a minimum effect on the engine compression ratio. The small passages or perforations 34 in the peripheral wall 32 are preferably provided with check valves which may take the form of metal reeds 38 mounted along the outer side of the wall and operable to permit flow through the perforations 34 from the combustion chamber to the collection volume. One or more passages 40 connect with the collection volumes in the cylinder head and are in turn connected through means 42 with induction system passages 44 leading to the cylinder intake ports 26.

The recirculation passages 40 are controlled by poppet valves 46 that are actuated by suitable means such as rocker levers 48 and camshaft 50, the latter is driven by the engine in timed relation with the piston 16, so that the valves 46 are opened at predetermined times of each engine cycle. When a valve 46 is opened, flow is permitted from the collection volume 36 to the engine induction system, which in turn permits the escape of gaseous products from the associated combustion chamber 24 to its collection volume 36 through the perforations 34.

Such flow is preferably timed to take place shortly after the termination of combustion on the expansion stroke of the associated piston when the quench layer is fully formed and causes the layer of combustibles along the perforated wall to be swept out of the combustion chamber and into the collection volume for recirculation through the passages 42, 44 to the engine induction system. The time of opening of the control valve is kept short so that the pressure lost from the combustion chamber will not be great.

Subsequently, if desired, the control valve 46 may be opened near the end of the exhaust stroke to permit the removal from the combustion chamber to the collection volume of further quench layer combustibles which have been scraped upwardly along the cylinder wall by the upward motion of the piston. In this way, additional combustibles are recirculated to the induction system and prevented from being lost through the engine exhaust system, thus reducing engine exhaust hydrocarbon emissions and improving efficiency.

Figure 2:
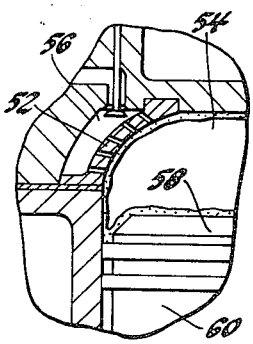
FIGS. 2 and 3 are fragmentary cross-sectional views of alternative engine embodiments similar to FIG. 1, but including modified forms of combustion chambers and collection volumes.

FIG. 2 illustrates an alternative arrangement of combustion chamber and collection volume in an engine similar to that of FIG. 1. The arrangement differs in providing an annular wall 52 of curved cross section so that the outer edges of the combustion chamber 54, and the shape of the collection volume 56 are modified accordingly, as is the head portion 58 of the piston 60. In other ways, the construction of the engine is similar to that of FIG. 1.

Figure 3:
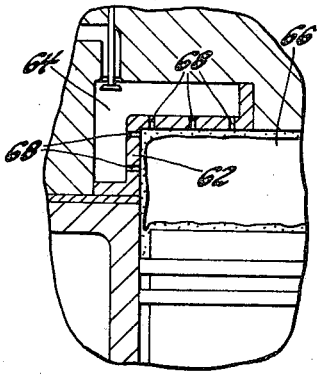

FIG. 3 illustrates another embodiment in which the annular wall 62 is of generally L-shaped cross section, as is the associated collection volume 64. The latter extends both beside and above portions of the combustion chamber 66 and is connected therewith through perforations 68 which extend both radially and axially through annular wall 62.

Figure 4:
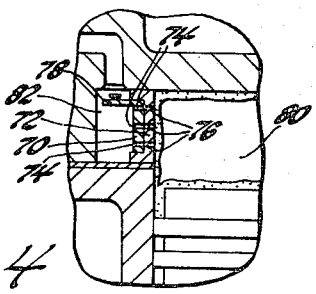
FIG. 4 is a fragmentary cross-sectional view of an engine similar to FIG. 1, but including an alternative form of control valving.

FIG. 4 illustrates a modified form of the engine of FIG. 1 in which the check valves 38 and the poppet control valve 46 are eliminated and are replaced by a sliding ring valve 70 which extends around the exterior of the peripheral wall 72. Ring valve 70 includes perforations 74 which may be moved into and out of alignment with the matching perforations 76 of wall 72. A suitable linkage 78 is provided to control the oscillating motion of the ring valve 70 through connection with an engine timing cam or the like, not shown. This mechanism times the opening and closing periods of the wall perforations 76 to obtain the desired flow of quench gases from the combustion chamber 80 to the associated collection volume 82. The timing of the open periods is preferably as described for the engine of FIG. 1.

The removal of major portions of the combustibles making up the cylinder wall quench layer before they have a chance to enter the engine exhaust system reduces the amount of hydrocarbons in the engine exhaust, as well as aiding engine efficiency, by the recovery and reburning of hydrocarbons and other combustibles which would otherwise be lost.

While the invention has been described by reference to certain embodiments selected for purposes of illustration, it should be understood that numerous changes could be made in the structures by which the disclosed method is carried out without departing from the inventive concepts taught. Accordingly, it is intended that the invention not be limited except by the language of the following claims.

What is claimed is:

1. The combination in an internal combustion engine of wall means defining a variable volume combustion chamber in which cyclic combustion of air-fuel mixtures is performed in repetitive cycles including admission, compression, combustion, expansion and exhaust steps, inlet and exhaust means for respectively admitting air-fuel mixtures to the chamber in the admission step and discharging burned products from the chamber in the exhaust step, said combustion step leaving a quench layer of unburned and partially burned combustibles on said wall means which may be stripped off and discharged in the exhaust step, and the improvement comprising, a collection volume adjacent said combustion chamber and separated therefrom by a stationary portion of said wall means, said portion having an areal pattern of perforations substantially coextensive therewith and interconnecting said combustion chamber and collection volume through said wall portion, passage means connecting said collection volume to said inlet means, valve means controlling the flow of fluids from said combustion chamber through said collection volume to said inlet means, and actuating means operable in predetermined relation to the engine operating cycle to open said valve means for predetermined portions of the expansion and exhaust steps of said combustion chamber cycle, the timing of said opening being effective to selectively strip the quench layer from said stationary wall means portion and recirculate the quench layer products to the inlet means for readmission to the combustion chamber, thus preventing discharge of the recirculated quench layer combustibles to said exhaust means.

2. In combination with an internal combustion engine of the type having a variable volume combustion chamber partially defined by a movable piston and means timed with the movements of said piston to perform in said chamber the steps of admission, compression and combustion of an air-fuel mixture and expansion and exhaust of the combustion products, wherein said combustion step leaves on the peripheral walls of said chamber, a quench layer of combustibles capable of being stripped away and exhausted with the combustion products, and the improvement comprising a collection volume at least partially surrounding said peripheral walls and connected with the adjacent portions of said combustion chamber by an areal pattern of perforations through the surrounded portions of said walls, passage means connecting said collection volume to said combustion chamber for recirculation of the collection volume contents to said combustion chamber for burning, and valve means operable in timed relation with said piston to permit flow through said collection volume from said combustion chamber only during predetermined portions of said expansion and exhaust steps, the timing of said flow being effective to selectively strip the quench layer of combustibles from said peripheral wall portions and subsequently recirculate the combustibles to the combustion chamber for burning, thus preventing the discharge of the recirculated quench layer combustibles to said exhaust means.

3. The combination of claim 2 wherein said valve means is disposed in said passage means and directly controls flow between said collection volume and said passage means.

4. The combination of claim 3 and further including check valves associated with said perforations and permitting flow therethrough only from said combustion chamber to said collection volume.

5. The combination of claim 2 wherein said valve means is associated with said perforations and directly controls flow between said combustion chamber and said collection volume.

6. The method of limiting the discharge of combustible gases to the exhaust system of an internal combustion engine having a combustion chamber, the fixed walls of which quench the combustion process in adjacent gases, thus forming a quench layer of combustibles on and adjacent the surfaces of said fixed walls and which remains after the combustion process but is subject to being stripped therefrom and discharged during the combustion chamber exhaust phase, said method comprising selectively discharging from the combustion chamber a substantial portion of the quench layer gases adjacent said fixed wall surfaces while retaining the main body of burned gases in said chamber, said selective discharge step being at least partially performed, following the combustion portion of each chamber cycle and in advance of the discharge to the exhaust system of substantial products of combustion from each said cycle, and recirculating said selectively discharged quench layer gases to the engine intake system for subsequent readmission to a combustion chamber on another cycle.

* * * * *